US008814579B2

(12) United States Patent
Chen et al.

(10) Patent No.: US 8,814,579 B2
(45) Date of Patent: Aug. 26, 2014

(54) ELECTRICAL CONNECTOR AND CONNECTING UNIT THEREOF

(71) Applicant: Wistron Corp., New Taipei (TW)

(72) Inventors: Chih-Ta Chen, New Taipei (TW); Yao-Wei Wang, New Taipei (TW); Ting-Yao Cheng, New Taipei (TW); Shih-Jung Chuang, New Taipei (TW)

(73) Assignee: Wistron Corp., New Taipei (TW)

( * ) Notice: Subject to any disclaimer, the term of this patent is extended or adjusted under 35 U.S.C. 154(b) by 62 days.

(21) Appl. No.: 13/678,457

(22) Filed: Nov. 15, 2012

(65) Prior Publication Data

US 2013/0252480 A1 Sep. 26, 2013

(30) Foreign Application Priority Data

Mar. 26, 2012 (TW) ..... 101110322 A

(51) Int. Cl.

| | |
|---|---|
| ***H01R 12/00*** | (2006.01) |
| ***H01R 12/57*** | (2011.01) |
| ***H01R 13/405*** | (2006.01) |
| *H01R 12/72* | (2011.01) |

(52) U.S. Cl.

CPC ..... *H01R 13/405* (2013.01); *H01R 12/57* (2013.01); *H01R 12/722* (2013.01)

USPC ..... 439/79; 439/569

(58) Field of Classification Search

USPC ..... 439/79, 569, 66

See application file for complete search history.

(56) References Cited

U.S. PATENT DOCUMENTS

| | | | | | |
|---|---|---|---|---|---|
| 5,096,426 | A * | 3/1992 | Simpson et al. | ..... | 439/66 |
| 5,199,889 | A * | 4/1993 | McDevitt, Jr. | ..... | 439/66 |
| 5,316,489 | A * | 5/1994 | Kachlic et al. | ..... | 439/79 |
| 6,022,224 | A * | 2/2000 | Peters | ..... | 439/66 |
| 6,095,865 | A * | 8/2000 | Wu | ..... | 439/607.01 |
| 6,149,443 | A * | 11/2000 | Moran | ..... | 439/66 |
| 6,224,396 | B1 * | 5/2001 | Chan et al. | ..... | 439/71 |
| 6,997,752 | B2 * | 2/2006 | Kato et al. | ..... | 439/637 |
| 7,217,159 | B2 | 5/2007 | Chung | | |
| 7,458,826 | B1 * | 12/2008 | Maatta | ..... | 439/79 |
| 7,670,150 | B2 * | 3/2010 | Hisamatsu et al. | ..... | 439/79 |
| 7,891,983 | B2 * | 2/2011 | Ichimura et al. | ..... | 439/66 |
| 8,118,604 | B2 * | 2/2012 | Ma | ..... | 439/70 |
| 8,366,452 | B2 * | 2/2013 | Yeh | ..... | 439/66 |
| 2005/0026474 | A1 * | 2/2005 | Li | ..... | 439/79 |
| 2006/0089022 | A1 * | 4/2006 | Sano | ..... | 439/79 |
| 2009/0011623 | A1 * | 1/2009 | Hisamatsu et al. | ..... | 439/79 |

OTHER PUBLICATIONS

Taiwan Patent Office, Office Action, Patent Application Serial No. 101110322, Oct. 9, 2013, Taiwan.

* cited by examiner

*Primary Examiner* — Gary Paumen

(57) ABSTRACT

An electrical connector is provided, including a substrate, an electronic element, a plurality of metal members, and an insulating sheet. The electronic element includes a plurality of terminals. The substrate forms a recess with the electronic element disposed therein. The metal members are disposed on the electronic element and insulated from each other. Additionally, the metal members connect the terminals with the substrate. The insulating sheet connects to the metal members and is adjacent to the electronic element.

18 Claims, 5 Drawing Sheets

ELECTRICAL CONNECTOR AND CONNECTING UNIT THEREOF

CROSS REFERENCE TO RELATED APPLICATIONS

The present application is based on, and claims priority from, Taiwan Patent Application No. 101110322, filed on Mar. 26, 2012, the disclosure of which is hereby incorporated by reference herein in its entirety.

BACKGROUND OF THE INVENTION

1. Field of the Invention

The application relates in general to an electrical connector, and in particular, to an electrical connector with reduced height from the electrical connector to a substrate.

2. Description of the Related Art

Miniaturization of notebook computers and portable electronic devices has become a design trend in recent years. As the thicknesses of electronic devices have decreased, the space for electronic elements therein has also decreased. Furthermore, the electronic elements are disposed on a substrate, making miniaturization even more difficult.

BRIEF SUMMARY OF INVENTION

An embodiment of the invention provides an electrical connector, comprising a substrate, an electronic element, a plurality of metal members, and an insulating sheet. The electronic element includes a plurality of terminals. The substrate forms a recess with the electronic element disposed therein. The metal members are disposed on the electronic element and insulated from each other. Additionally, the metal members connect the terminals with the substrate. The insulating sheet connects to the metal members and is adjacent to the electronic element.

BRIEF DESCRIPTION OF DRAWINGS

The invention can be more fully understood by reading the subsequent detailed description and examples with references made to the accompanying drawings, wherein.

DETAILED DESCRIPTION OF INVENTION

Figure 1A:
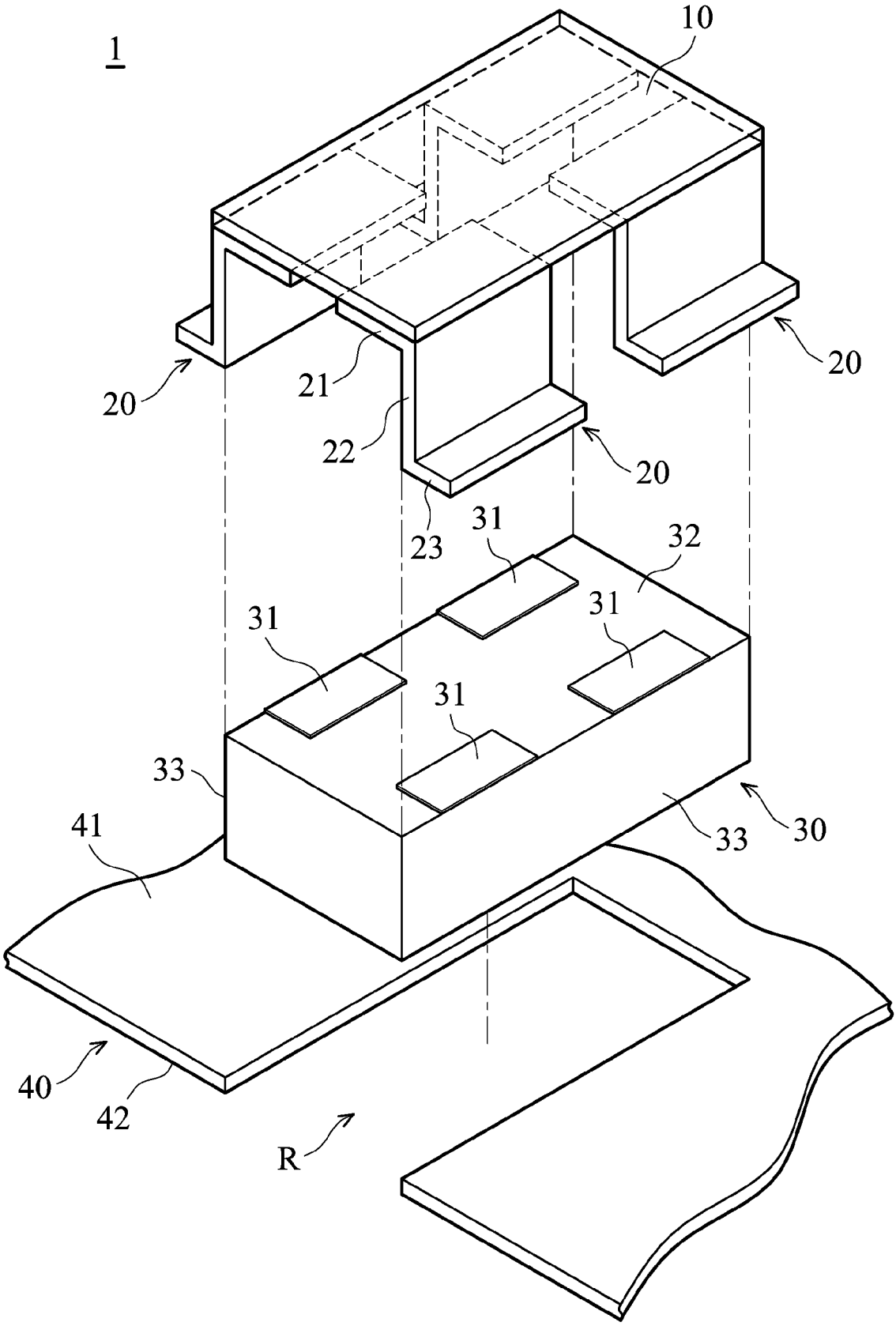
FIG. 1A is an exploded diagram of an electrical connector according to an embodiment of the invention.
Figure 1B:
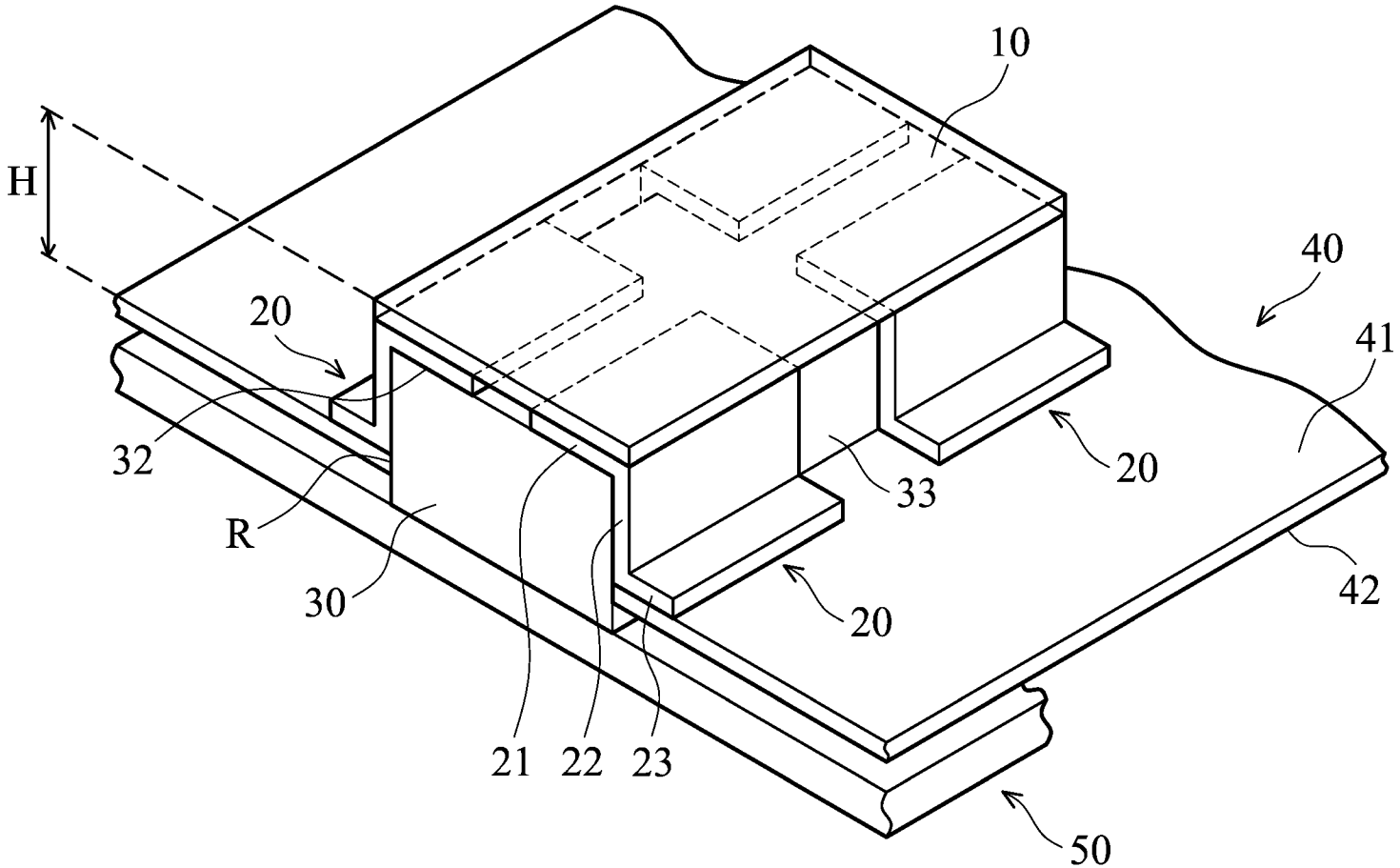
FIG. 1B is a perspective diagram of an electrical connector according to an embodiment of the invention.

Referring to FIGS. 1A and 1B, an embodiment of an electrical connector 1 primarily comprises an insulating sheet 10, a plurality of metal members 20, an electronic element 30, and a substrate 40. As shown in FIG. 1A, the substrate 40 may be a printed circuit board with electrical circuits disposed thereon. A recess R is formed at an edge of the substrate 40. The electronic element 30, such as an audio jack or a power switch, is disposed in the recess R for reducing the height H from the substrate 40 to the insulating sheet 10 (FIG. 1B). It should be noted that the insulating sheet 10 and the metal members 20 comprise a connecting unit, wherein the metal members 20 connects the substrate 40 with the electronic element 30. The insulating sheet 10 is disposed on the metal members 20 and adjacent to the electronic element 30, wherein the insulating sheet 10 may comprise plastic.

Referring to FIG. 1A, the electronic element 30 comprises a top surface 32, two side surfaces 33 adjacent to the top surface 32 and opposite to each other, and a plurality of terminals 31 disposed on the top surface 32. The metal members 20 are connected to the insulating sheet 10, and spaced apart from each other for insulation. Each of the metal members 20 is substantially Z-shaped and forms a first portion 21, a second portion 22, and a third portion 23. The insulating sheet 10, the first portion 21, and the third portion 23 are substantially perpendicular to the second portion 22, and the terminals 31 connect to the first portions 21 of the metal members 20.

Referring to FIG. 1B, during assembly of the insulating sheet 10, the metal members 20, the electronic element 30, and the substrate 40, the first portions 21 of the metal members 20 connect the insulating sheet 10 and the terminals 31, the second portions 22 are adjacent to the side surfaces 33 of the electronic element 30, and the third portions 23 are connected to the substrate 40. Thus, the electronic element 30 electrically connects to the substrate 40 through the metal members 20. It should be noted that since the electronic element 30 is disposed in the recess R of the substrate 40, the height H from the substrate 40 to the insulating sheet 10 can be effectively reduced. Furthermore, a housing 50 may be provided and directly connected to the electronic element 30 from the bottom side thereof, so as to keep the electronic element 30 fixed between the metal member 20 and the housing 50. It should be noted that the insulating sheet 10 and the metal members 20 are made of different materials, and they can be connected to each other by insert molding or nano molding technology (MWT).

Figure 2:
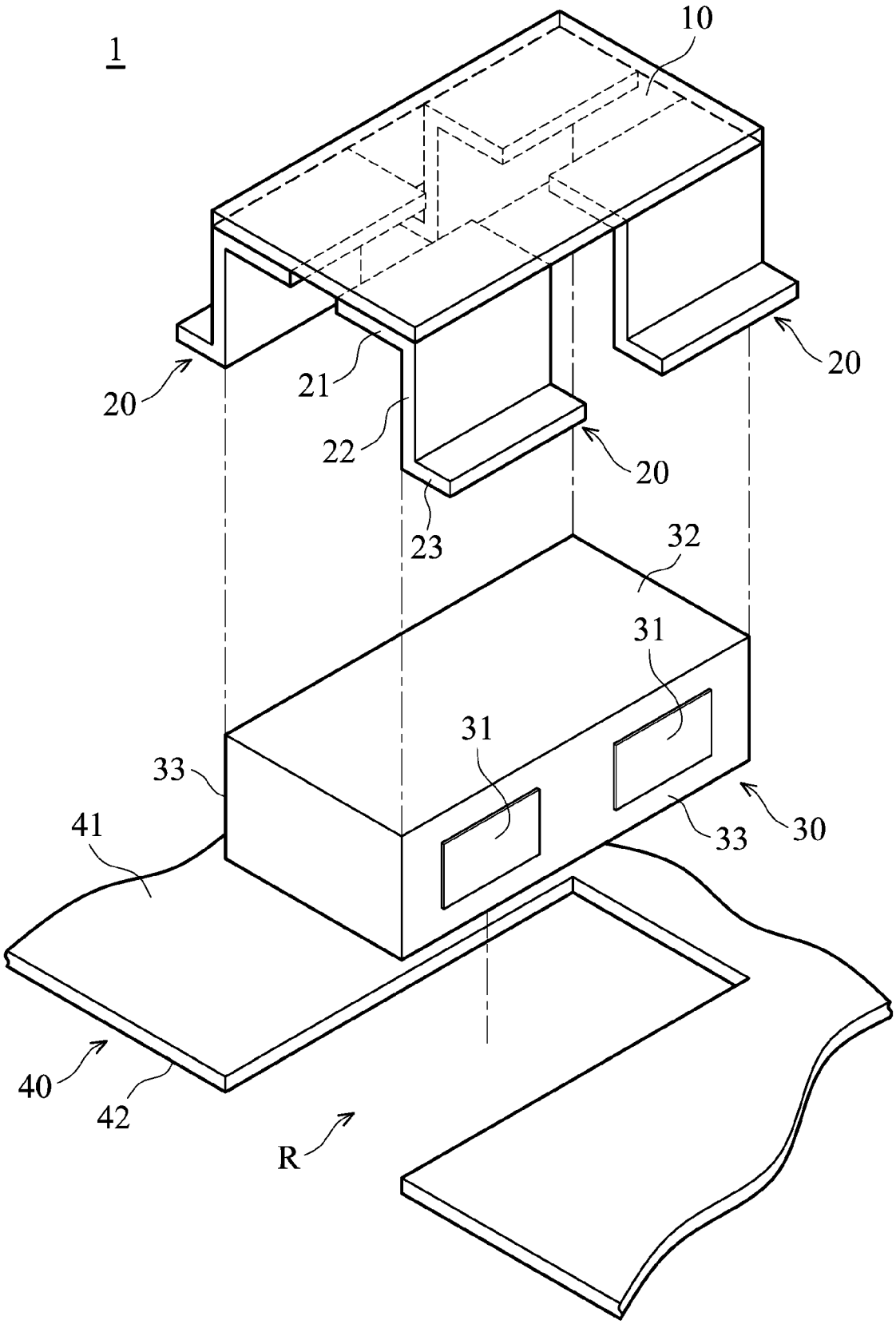
FIG. 2 is an exploded diagram of an electrical connector according to another embodiment of the invention.

Referring to FIG. 2, in another embodiment, the terminals 31 of the electronic element 30 are disposed on the side surfaces 33 and connected to the second portions 22 of the metal members 20, thereby electrically connecting the substrate 40 through the third portions 23 of the metal members 20.

Figure 3A:
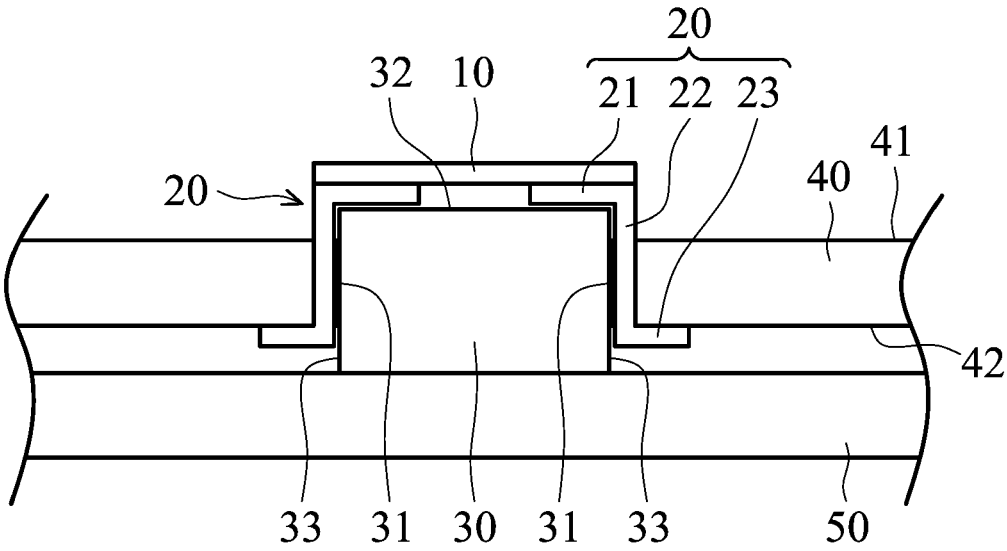
FIG. 3A is a perspective diagram of an electrical connector according to another embodiment of the invention.

Referring to FIG. 3A, different structures and heights of the metal members 20 may be appropriately designed corresponding to the height from the substrate 40 to the insulating sheet 10. Additionally, the metal members 20 may also be appropriately designed and arranged corresponding to the positions of the terminals 31 and the electrical circuits on the substrate 40. As shown in FIG. 3A, in some embodiments, the second portions 22 of the metal members 20 are extended through the recess R, such that the third portions 23 directly contact a second surface 42 of the substrate 40. Accordingly, the metal members 20 electrically connect the electrical device 30 and the electrical circuits on the second surface 42 of the substrate 40. It is noted that the housing 50 may directly connect the electronic element 30 from the bottom side thereof for keeping the electronic element 30 fixed between the metal member 20 and the housing 50.

Figure 3B:
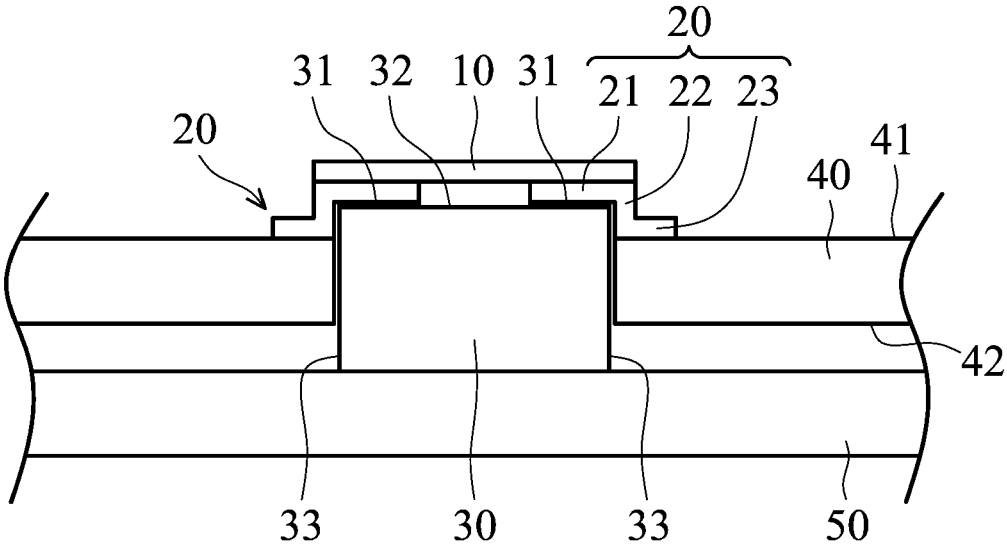
FIG. 3B is a perspective diagram of an electrical connector according to another embodiment of the invention.
Figure 3C:
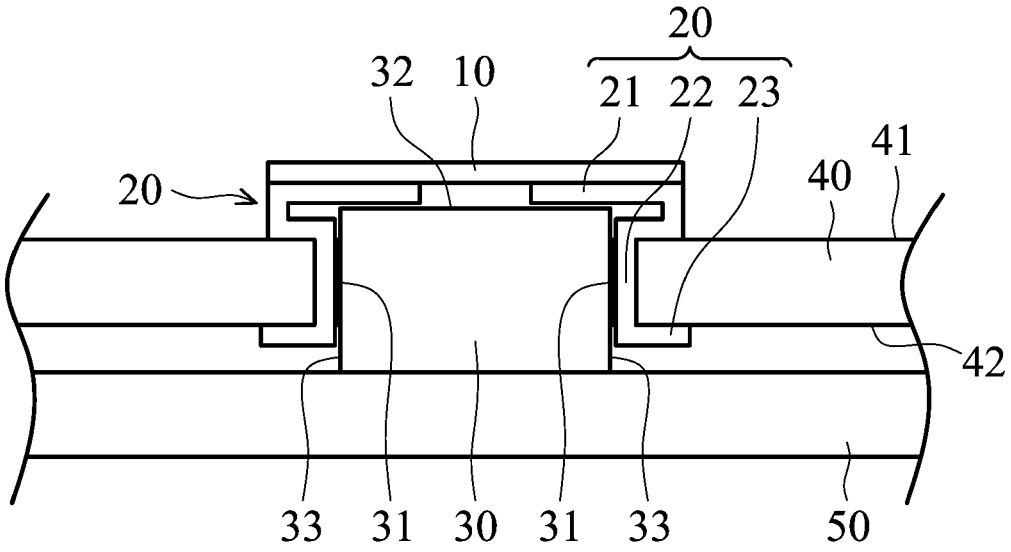
FIG. 3C is a perspective diagram of an electrical connector according to another embodiment of the invention.

As shown in FIG. 3B, the terminals 31 of the electronic element 30 may be disposed on the top surface 32 of the electronic element 30, whereby the metal members 20 electrically connect the electronic element 30 with the electrical circuits on the first surface 41 of the substrate 40. Referring to FIG. 3C, in another embodiment, the metal members 20 are substantially S-shaped, wherein the first portions 21 and the second portions 22 of the metal members 20 respectively form an L-shaped structure, and the upper sections of the second portions 22 directly contact the first surface 41 of the substrate 40, and the third portions 23 directly connect the second surface 42 of the substrate 40. Thus, the metal members 20 can electrically connect the electronic element 30 with the electrical circuits on both the first and second surface 41 and 42 of the substrate 40.

The invention provides an electrical connector, including a substrate, an electronic element, a plurality of metal members, and an insulating sheet. The electronic element comprises a connector or a power switch. The substrate forms a recess with the electronic element disposed therein. The metal members electrically connect the terminals of the electronic element with the electrical circuit on the substrate. The electronic element is received in the recess for reducing the height from the substrate to the insulating sheet, so as to achieve miniaturization of the electronic element.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. An electrical connector, comprising:

a substrate, forming a recess;

an electronic element disposed in the recess, wherein the electronic element has a top surface, two side surfaces adjacent to the top surface, and a plurality of terminals disposed on the top surface or the side surfaces;

a plurality of metal members disposed on the electronic element, wherein the metal members are insulated from each other and electrically connect the terminals with the substrate; and an insulating sheet connected to the metal members, wherein the metal members are disposed between the insulating sheet and the electronic element.

2. The electrical connector as claimed in claim 1, wherein the electronic element comprises an audio jack or a power switch.

3. The electrical connector as claimed in claim 1, wherein the insulating sheet is connected to the metal members by insert molding.

4. The electrical connector as claimed in claim 1, wherein the insulating sheet is connected to the metal members by nano molding technology.

5. The electrical connector as claimed in claim 1, wherein each of the metal members forms a first portion and a second portion, and the first portions are adjacent to the top surface of the electronic element, and the second portions are adjacent to the side surfaces of the electronic element.

6. The electrical connector as claimed in claim 5, wherein the metal members are substantially Z-shaped, and each of the metal members further forms a third portion connected to the substrate.

7. The electrical connector as claimed in claim 1, wherein the recess is formed at the edge of the substrate.

8. The electrical connector as claimed in claim 1, wherein the electrical connector further comprises a housing connected to the electronic element, and the electronic element is fixed between the housing and the metal members.

9. The electrical connector as claimed in claim 1, wherein the metal members are disposed through the recess and connected to the substrate.

10. The electrical connector as claimed in claim 1, wherein the metal members are substantially S-shaped, and the substrate has a first surface and a second surface on opposite sides thereof, wherein the metal members are extended through the recess to connect the first surface with the second surface.

11. A connecting unit for electrically connecting an electronic element with a substrate, comprising:

a plurality a metal members insulated from each other, wherein each of the metal members forms a first portion, a third portion, and a second portion connecting the first portion with the third portion; and an insulating sheet connected to the metal members, wherein the first portions and the third portions are substantially parallel to the insulating sheet;

wherein the metal members are substantially S-shaped, and the substrate forms a recess, a first surface, and a second surface on opposite sides thereof, wherein the metal members are disposed through the recess and connect the first surface with the second surface.

12. The connecting unit as claimed in claim 11, wherein the insulating sheet is connected to the metal members by insert molding.

13. The connecting unit as claimed in claim 11, wherein the insulating sheet is connected to the metal members by nano molding technology.

14. A connecting unit for electrically connecting an electronic element with a substrate, comprising:

a plurality a metal members insulated from each other, wherein each of the metal members forms a first portion, a third portion, and a second portion connecting the first portion with the third portion; and an insulating sheet connected to the metal members, wherein the first portions and the third portions are substantially parallel to the insulating sheet;

wherein the electronic element has a top surface and two side surfaces adjacent to the top surface, the first portions are adjacent to the top surface of the electronic element, and the second portions are adjacent to the side surfaces of the electronic element.

15. The connecting unit as claimed in claim 14, wherein the metal members are substantially Z-shaped, and the third portions are connected to the substrate.

16. The connecting unit as claimed in claim 14, wherein the insulating sheet is connected to the metal members by insert molding.

17. The connecting unit as claimed in claim 14, wherein the insulating sheet is connected to the metal members by nano molding technology.

18. The connecting unit as claimed in claim 14, wherein a recess is formed on the substrate, and the metal members are disposed through the recess and connected to the substrate.

* * * * *